US006900740B2

(12) United States Patent
Bloomquist et al.

(10) Patent No.: US 6,900,740 B2
(45) Date of Patent: May 31, 2005

(54) AUTONOMOUS HIGHWAY TRAFFIC MODULES

(75) Inventors: David Bloomquist, Gainesville, FL (US); Michael McVay, Gainsville, FL (US); Erik G. Larsson, Gainesville, FL (US); Christopher Dumas, Arlington, VA (US)

(73) Assignee: University of Florida Research Foundation, Inc., Gainesville, FL (US)

( * ) Notice: Subject to any disclaimer, the term of this patent is extended or adjusted under 35 U.S.C. 154(b) by 0 days.

(21) Appl. No.: 10/336,533

(22) Filed: Jan. 3, 2003

(65) Prior Publication Data

US 2004/0130463 A1 Jul. 8, 2004

(51) Int. Cl.[7] ..... G08G 1/09

(52) U.S. Cl. ..... 340/905; 340/907; 340/932; 701/119

(58) Field of Search ..... 340/905, 906, 340/907, 908, 910, 917, 286.01, 286.02, 903, 933, 932; 701/117, 118, 119; 370/236, 324, 503; 348/118, 119, 148, 149

(56) References Cited

U.S. PATENT DOCUMENTS 3,529,284 A * 9/1970 Villemain ..... 340/932
4,241,326 A 12/1980 Odom
4,321,589 A * 3/1982 King ..... 340/906
4,641,317 A 2/1987 Fullerton
4,926,163 A 5/1990 Beebe
5,109,224 A * 4/1992 Lundberg ..... 340/907
5,289,183 A * 2/1994 Hassett et al. ..... 340/905
5,363,108 A 11/1994 Fullerton
5,673,039 A * 9/1997 Pietzsch et al. ..... 340/905
5,677,927 A 10/1997 Fullerton et al.
5,687,169 A 11/1997 Fullerton
5,771,484 A 6/1998 Tognazzini
6,031,862 A 2/2000 Fullerton et al.
6,064,318 A * 5/2000 Kirchner et al. ..... 340/905
6,107,941 A 8/2000 Jones
6,259,375 B1 7/2001 Andras
6,262,673 B1 7/2001 Kalina
6,295,019 B1 9/2001 Richards et al.
6,297,773 B1 10/2001 Fullerton et al.
6,304,816 B1 * 10/2001 Berstis ..... 701/117
6,317,058 B1 * 11/2001 Lemelson et al. ..... 340/910
6,317,682 B1 * 11/2001 Ogura et al. ..... 701/117
6,351,709 B2 * 2/2002 King et al. ..... 701/210
6,662,099 B2 * 12/2003 Knaian et al. ..... 701/117

* cited by examiner

*Primary Examiner*—Jeffery Hofsass
*Assistant Examiner*—Eric Blount
(74) *Attorney, Agent, or Firm*—Akerman Senterfitt

(57) ABSTRACT

A vehicle safety and control system provides early warning and includes a network including a plurality of remotely located modules disposed along a vehicle pathway. Each module is communicably connected to at least one of the other modules. The modules include a measurement system including at least one sensor for obtaining sensor data. The sensor data provides position and velocity data for objects proximate thereto. The modules also include an illuminated display having a plurality of observable distinct states, the observable states including states relating to the sensor data.

33 Claims, 2 Drawing Sheets

AUTONOMOUS HIGHWAY TRAFFIC MODULES

CROSS-REFERENCE TO RELATED APPLICATIONS

Not applicable.

STATEMENT REGARDING FEDERALLY SPONSORED RESEARCH OR DEVELOPMENT

Not applicable.

FIELD OF THE INVENTION

The invention relates to systems and methods for early warning, monitoring, and control of vehicles and the highways and other vehicle pathways traversed by the vehicles.

BACKGROUND

The interstate highway system is relatively fixed in its carrying capacity in terms of the number of lanes and miles of roadway. As more and more traffic utilizes these highways, the probability of accidents is likely to increase. Highway accidents already cause significant injury and death. In recent years, more than 40,000 Americans have died annually and another 5 million others have been injured in car crashes and other related automobile situations.

Many accidents can be avoided if drivers are alerted earlier to potentially dangerous road and weather conditions. Clearly, a system which could provide warning of impending danger or road hazards well before the impending danger or road hazards actually become visible to drivers could spare many lives and serious injury, as well as reduce related property damage.

In addition, hundreds of thousands of hours of time and millions of gallons of fuel are wasted during commuting due to highway congestion. It has been estimated that in large metropolitan areas about 75% of all car trips are commuter related and drivers can spend almost 50% of their commute time stopped in traffic. A disproportionate share of daily commuting time is associated with vehicle accidents. Moreover, during extreme events, such as hurricanes and flooding, timely evacuation is critical. In many instances, too many people attempt to evacuate at the same time on the same highway creating major congestion. If a system were able to automatically adjust traffic volume by redirecting a portion of traffic to feeder or alternative roadways, timesaving and gasoline saving, as well as improved disaster response would result.

SUMMARY OF THE INVENTION

A vehicle safety and control system provides early warning and includes a network comprising a plurality of remotely located modules disposed along a vehicle pathway. Each module is communicably connected to at least one of the other modules. The modules include a measurement system comprising at least one sensor for obtaining sensor data. The sensor data includes distance and velocity data for objects proximate thereto. The modules also include an illuminated display having a plurality of observable distinct states, the respective observable states relating to obtained sensor data, such as the presence of an accident. The remotely located modules can be affixed to fixed locations, such as anchored to a roadway surface.

The modules can further comprise a wireless transceiver for transmitting and receiving data including the sensor data between the plurality of remotely located modules, wherein the remotely located modules are all wirelessly interconnected. In a preferred embodiment, the transceiver comprises an ultra wideband (UWB) radio unit. The modules can also include a central processing unit (CPU).

The network can be divided into a plurality of sectors, the sectors each including at least one centralized node. The centralized node is wirelessly connected to respective ones of the plurality of modules in each of the sectors. The modules can include at least one solar panel, wherein the system can be powered at least in part by solar energy. The observable distinct states can be provided by at least one LED, the LED capable of continuous or pulsed illumination. At least one of the observable distinct states can indicate an approaching emergency vehicle.

The system can provide wireless communications between the plurality of modules and certain vehicles, such as vehicles having a car navigation system. The car navigation system can include a UWB transceiver.

The system can automatically provide real-time remote roadway information to vehicles traveling along the vehicle pathway. The remote roadway information can comprise traffic, accidents and/or weather information.

Transmissions from each of the plurality of modules are preferably distinguishable from one another, at least within a given sector. The sensor can include a visibility sensor for detecting fog, rain and smoke.

The vehicle pathway can comprise a motor vehicle roadway or a navigable waterway. The motor vehicle roadway can include portions on an interstate highway system. The remotely located modules can be disposed in a staggered configuration along alternating sides of the vehicle pathway.

A method for warning or directing vehicles includes the steps of disposing a network including a plurality of remotely located modules along a vehicle pathway, the modules each comprising at least one sensor for sensing distance and velocity of objects proximate to the modules. The modules are each communicably connected to at least one other of the plurality of modules. Visual warning or directing signals using a plurality of observable distinct lit states at the modules are provided, the states relating to the sensor data. The observable distinct lit states can be provided by at least one LED, the LED capable of continuous or pulsed illumination.

The method can include the step of communicating a wireless warning or control signal to vehicles traveling on the vehicle pathway, such as to vehicles which include a car navigation system. The method can include the step of automatically providing real-time remote roadway information to operators of automobiles via the car navigation system.

A method of sequencing traffic lights includes the step of determining a vehicle traffic queue at or approaching a road intersection for each of a plurality of intersecting paths comprising the intersection, each of the paths having an associated traffic signal. Respective times for the traffic signals are then set based on the determined traffic queue. Radar, such as provided by a plurality of remotely located UWB units, can be used to determine the traffic queue. The radar can be disposed along a right of way near the intersecting paths.

BRIEF DESCRIPTION OF THE DRAWINGS

The invention is pointed out with particularity in the appended claims. The above and further advantages of this invention may be better understood by referring to the following description taken in conjunction with the accompanying drawings, in which:

DETAILED DESCRIPTION OF THE INVENTION

Figure 1:
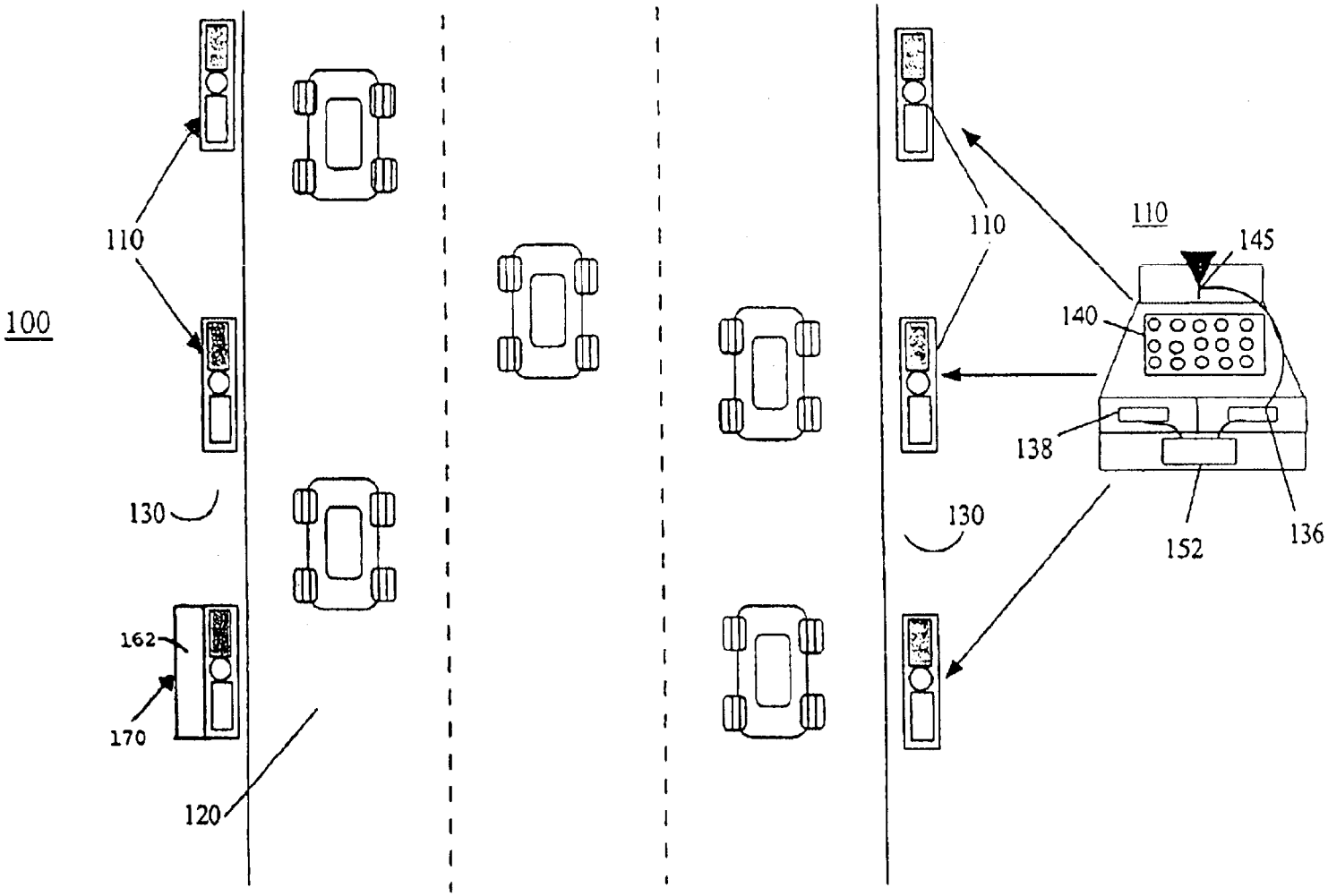
FIG. 1 illustrates a plurality of modules disposed along the right of way of a highway, according to an embodiment of the invention.

The invention is a safety and control system which provides early warning, monitoring, and control of vehicles and the vehicle pathways traversed by the vehicles. In a preferred embodiment, the system utilizes ultra wideband (UWB) radio technology to enable tracking of vehicles, and monitoring of a variety of parameters associated with highways to provide early warning to motorists. As used herein, the phrase "early warning" refers to warning signals which reach the motorist before the impending danger or road hazards would otherwise actually become directly visible to the motorist. Used as a control system, the invention can be used to help remotely and automatically control operation of vehicles and safety devices provided in the vehicles.

Many of these capabilities are made possible, or at least enhanced, by the use of an emerging, revolutionary ultra wideband technology (UWB), which is sometimes referred to as impulse radio which is one of its common forms. UWB signals have also come to signify a number of other terms, such as impulse, carrier-free, baseband, time domain, nonsinusoidal, orthogonal function and large-relative-bandwidth radio/radar signals. As used herein, the term "UWB" includes all of these.

UWB wireless technology provides very low power consumption (microwatts), virtual immunity from RF noise and distance measuring capabilities that makes it well suited for use with this invention. UWB may also provide improved security over alternative communication methodologies. Significantly, UWB does not interfere with signals used by existing communication systems, such as cellular communication signals.

UWB is believed by many to have been first fully described in a series of patents including U.S. Pat. No. 4,641,317 and U.S. Pat. No. 5,363,108 to Larry W. Fullerton. A second generation of Fullerton UWB patents include U.S. Pat. Nos. 5,677,927, 5,687,169, 6,031,862. Fullerton also discloses use of UWB for position determination and distance measurements in U.S. Pat. Nos. 6,297,773 and 6,295,019, respectively.

UWB, when implemented via impulse hopping, refers to a radio system based on short, low duty cycle pulses. An ideal UWB radio waveform is a short Gaussian monocycle. This waveform attempts to approach one cycle of radio frequency (RF) energy at a desired center frequency. Due to implementation and other spectral limitations, the waveform is generally altered significantly for most applications. Most waveforms with enough bandwidth approximate a Gaussian shape.

UWB can use many types of modulation, including time shift (pulse position), baseband direct sequence spread spectrum and M-ary. The time shift method has simplicity and power output advantages that make it generally the most desirable for most applications.

In UWB communications, the pulse-to-pulse interval can be varied on a pulse-by-pulse basis by two components, an information component and a code component. Generally, conventional spread spectrum systems employ codes to spread the normally narrow band information signal over a relatively wide band of frequencies. A conventional spread spectrum receiver is used to correlate these signals to retrieve the original information signal. Unlike conventional spread spectrum systems, in UWB communications codes are not needed for energy spreading because the monocycle pulses themselves have an inherently wide bandwidth. Instead, codes are used for channelization, energy smoothing in the frequency domain, resistance to interference, and reduction of interference to nearby receivers.

The UWB radio receiver is typically a direct conversion receiver with a cross correlator front end which can coherently convert an electromagnetic pulse train of monocycle pulses to a baseband signal in a single stage. The baseband signal is the basic information signal for the UWB-based communications system. It is generally desirable to include a subcarrier with the baseband signal to help reduce the effects of amplifier drift and low frequency noise. The subcarrier is typically implemented to alternately reverse modulation according to a known pattern at a rate faster than the data rate. This same pattern is used to reverse the process and restore the original data pattern just before detection. This method permits alternating current (AC) coupling of stages, or equivalent signal processing to eliminate direct current (DC) drift and errors from the detection process.

In UWB communications utilizing time shift modulation, each data bit typically time position modulates many pulses of the periodic timing signal. This yields a modulated, coded timing signal that comprises a train of pulses for each single data bit. The UWB receiver integrates multiple pulses to recover the transmitted information.

In the widest bandwidth embodiment, the resulting UWB waveform approaches one cycle per pulse at the center frequency. In more narrow band embodiments, each pulse consists of a burst of cycles usually with some spectral shaping to control the bandwidth to meet desired properties such as out of band emissions or in-band spectral flatness, or time domain peak power or burst off time attenuation.

For system analysis purposes, it is convenient to model the desired waveform in an ideal sense to provide insight into the optimum behavior for detail design guidance. One such waveform model that has been useful is the Gaussian monocycle. This waveform is representative of the transmitted pulse produced by a step function into an UWB antenna.

UWB systems can deliver one or more data bits per pulse. However, UWB systems more typically use pulse trains, not single pulses, for each data bit.

Coding provides a method of establishing independent communication channels using UWB. Codes can be designed to have low cross correlation such that a pulse train using one code will seldom collide on more than one or two pulse positions with a pulses train using another code during any one data bit time. Since a data bit may comprise hundreds of pulses, this represents a substantial attenuation of the unwanted channel.

Any aspect of the waveform can be modulated to convey data or other information. Amplitude modulation, phase modulation, frequency modulation, time shift modulation and M-ary versions can be used to convey data. Both analog and digital forms can be been implemented. Of these, digital time shift modulation has been demonstrated to provide various advantages including easy implementation using a correlation receiver architecture.

Digital time shift modulation can be implemented by shifting the coded time position by an additional amount (in addition to code dither) in response to the information signal. This amount is typically very small relative to the code shift. In a 10 Mpps system with a center frequency of 2 GHz, for example, the code may command pulse position variations over a range of about 100 ns; whereas, the information modulation may only deviate the pulse position by about 150 ps.

Thus, in a pulse train of n pulses, each pulse is delayed a different amount from its respective time base clock position by an individual code delay amount plus a modulation amount, where n is the number of pulses associated with a given data symbol digital bit. Modulation can further smooth the spectrum, minimizing structure in the resulting spectrum.

If there were a large number of UWB users within a confined area, there can be mutual interference. Further, while coding minimizes that interference, as the number of users rises, the probability of an individual pulse from one user's sequence being received simultaneously with a pulse from another user's sequence increases. UWB radios are able to perform in these environments, in part, because they do not depend on receiving every pulse. The UWB receiver performs a correlating, synchronous receiving function (at the RF level) that uses a statistical sampling and combining of many pulses to recover the transmitted information.

UWB receivers typically integrate from 1 to 1000 or more pulses to yield the demodulated output. The optimal number of pulses over which the receiver integrates is dependent on a number of variables, including pulse rate, bit rate, interference levels, and range.

Besides channelization and energy smoothing, coding also makes UWB radios highly resistant to interference from all radio communications systems, including other UWB radio transmitters. This is critical as other signals within the band occupied by a UWB signal could otherwise potentially interfere with the UWB radio. Since there are currently no unallocated bands available for UWB systems, they must share spectrum with other conventional radio systems without being adversely affected. The code helps UWB systems discriminate between the intended UWB transmission and interfering transmissions from others.

FIG. 1 illustrates an exemplary vehicle safety and control system 100. System 100 includes a communicably connected network comprising a plurality of remotely located modules 110 disposed adjacent to a vehicle pathway 120, such as along the right of way of highway 130. Only one direction of highway 130 is shown for simplicity in FIG. 1.

Modules 110 include an illuminated display 140. Display 140 provides a plurality of observable distinct states, the states relating to the obtained sensor data. For example, the states can be indicated by one or more colored lights, such as green lights, red lights and yellow lights. FIG. 1 shows modules 110 on both sides of highway 130, although modules can be disposed on only one side of highway 130.

Although not shown in FIG. 1, modules 110 can also be disposed between lanes of a highway, such as where lane dividing reflectors are currently located. In this embodiment, a single module can provide illumination signals to direct lanes on both sides of the module. For example, a dividing wall (not shown) extending out several inches from the face of display 140 can separate lights on the left side of the module to control the lane to the left of the module, while lights on the right side of module can control the right side. Accordingly, in this embodiment, all four lanes of a four lane highway can be controlled by two (2) modules 110.

A typical spacing distance between modules 110 can be 30 to 100 feet, or more, only limited by the power allocated and the corresponding ability to transmit and receive wireless communication between adjacent modules 110. The modules are preferably low profile, such as generally two (2) inches or less. The module size is preferably chosen such that vehicular traffic can pass over them without damaging the vehicles. In addition, modules 110 can include shock absorbing material therein to prevent damage from vehicles passing over modules 110. Modules 110 are preferably waterproof. Waterproofing is preferably provided using a polymeric encapsulation layer.

The modules 110 each include a measurement system comprising at least one sensor, such as sensors 136 and 138. For example, sensor 136 can obtain position and velocity data which together with computer 152 can determine position and velocity of these objects. Sensor 138 can include a visibility sensor to provide local weather monitoring. For example, visibility sensor 138 can detect visibility impairing driving conditions such as fog, precipitation or smoke and permit module 110 to also function as a weather sentry.

The modules each preferably include at least one UWB transceiver which can provide the function described relative to sensor 136, and is referred to as transceiver/sensor 136 in this embodiment. One or more UWB transceiver/sensors 136 can also be used to perform radar measurements, such as to provide data relating to vehicle distance from module 110, vehicle velocity, and vehicle acceleration. Data from a plurality of sensors, such as at least three (3) transceiver/sensors 136 can be used to triangulate the actual position of a given object. This can be used to determine accidents or other flow stoppages. Alternatively, a conventional radar system can be provided to perform the radar measurements.

Transceiver/sensor 136 is connected to antenna 145. Antenna 145 is preferably an essentially omnidirectional antenna. For example, at significant distances, such as tens of feet, dipole antennas generally behave as essentially omnidirectional antennas. Transceiver/sensor 136 can also provide communications directly to a plurality of neighboring modules, such as by transmitting detectable signals up to 100 feet. Signals can reach some or all deployed modules 110 in a system, such as through a series of modules which can function as repeaters.

Modules 110 are preferably arranged or grouped into sectors to facilitate communications among them. For example, approximately 40–60 modules can comprise a sector. The network is configured to be robust since data can be relayed to adjacent modules even if one or more modules 110 in a given sector fail.

An optional super node relay module 170 is shown. Super-node 170 generally includes all components provided by module 110 along with additional communications equipment. For example, in a preferred embodiment super-node 170 includes the communication elements commonly provided by cellular phones, such as an RF transceiver, filters, mixers, signal processors and an RF antenna, shown collectively as reference 162. Super-node preferably supports packet radio, such as GPRS protocol.

Super node 170 is positioned within communication range of a plurality of modules 110, such as modules constituting a sector, and can relay messages to modules from other remote sources (including other super nodes) as well as to modules 110 from other remote sources. Thus, a super node 170 in each sector can collect data from each module 110 in its sector and can transmits the status of each module 110, such as operational condition, particular light color currently illuminated, and power status to Intelligent Transportation System (ITS) station and its associated personnel, as well as to other adjacent sectors via their super nodes.

Together, the modules 110 and super nodes 170 effectively constitute a so-called ad-hoc sector network. The modules 110 can use available advanced medium access protocol to coordinate their transmission and reception. All modules 110 can be physically identical, but at the time of system setup, each unit can be assigned a unique code to provide unique identifiability. This code later can be used to distinguish signals from the various modules. Typically, the code can be a CDMA spreading code or pseudo-noise random sequence, but other possibilities are also available. Alternatively, using time multiplexing techniques, modules 110 can be identified by the times of transmission they are assigned.

If codes are used, the codes ensure that the sector modules 110 do not significantly interfere with each other, and largely overcomes the susceptibility to external radio interference, such as other UWB units in vehicles. The codes are preferably provided to the super node 170, so that there is a known geographical position mapping between code sequences. Since there are only a finite number of code sequences available, particular codes may be reused. This generally does not pose a problem because the range of a UWB device is typically much less than the reuse distance.

For example, after module 110 determines the location of an accident slowdown or stoppage, the information can be communicated to other modules 110, such as wirelessly and automatically using transceiver/sensor 136 and antenna 145. Thus, in the case of an accident, the module lights on display 140 in the affected lane could immediately and automatically be illuminated up to several miles in advance of the identified location, to provide early warning to arriving traffic of an impending accident, slowdown or stoppage.

For example, as shown in FIG. 1, modules 110 are located on both sides of a highway 130 having 2 lines in each direction. For this two lane highway 130, if the accident occurs in the right hand lane, the left hand lane lights could stay green while the right hand side could be rendered yellow or red, up to several miles ahead of the accident. Thus, the vehicles would know that they have to merge to the left, well before reaching the accident site. Once the accident is cleared, the lights could revert back to green.

The invention can also be used for automatic traffic control. Automatic traffic control can include automatically redirecting traffic to alternate roadways or lanes of a given highway in the event of an accident or a stalled vehicle, for example. Modules 110 can track vehicular movement and autonomously redirect a portion to other arteries.

Automatic traffic control can include identifying the traffic queue at an intersection and automatically adjusting light times accordingly. Major road intersections with advanced traffic light systems currently utilize a mechanism to detect approaching vehicles, such as magnetic strips or radar, and adjust the red/green sequencing of the traffic lights. Thus, present technology can provide sensors which can sense the presence of a car or a series of cars passing over a point at an intersection and a resulting trigger to turn a light green, but no provision for adjusting the time while the light is green based on queued vehicles. Never before has it been possible to efficiently base light times on the number of cars waiting at one or more traffic lights at an intersection.

For example, the invention can identify the vehicular traffic queue status in each direction and adjust the traffic lights to clear the intersection in the most efficient manner, such as on the basis of the distribution of vehicles at the intersection. This could drastically reduce the wait time for lights, because unlike fixed time sequencing lights or buried magnetic strips, the modules would monitor traffic conditions at much further distances away from the signals, and thereby adjust the light times of traffic lights accordingly, such as duration of green traffic lights. As a result, using this aspect of the invention, the periods during which lights are green would no longer include significant intervals when no traffic is utilizing the green signal while other traffic is waiting for a green signal.

Because the modules 110 provide radar distance measurements (ranging), vehicle velocities can be monitored by the system as well as to ITS headquarters on a real-time basis. As traffic passes a particular module 110, the velocity information can be acquired and processed. Thus, each module is capable of immediately and automatically altering its light color based on traffic conditions it recognizes. At the same time, this information is preferably communicated to the other modules (to alter their appropriate light color as well) in its sector as well as to the super node 170 in the sector. The super node 170 can communicate this sector status to the other affected sectors and to the ITS headquarters.

Since the modules 110 send and receive radar data to each other as well as to their sector super node 170, the system 100 is able to locate each vehicle and evaluate real-time traffic patterns, such as traffic counts and number of accidents in a sector. If multiple roads were instrumented, then routes can be automatically monitored and updated to notify traffic of the most efficient travel route.

It is expected that any three modules 110 can be used in conjunction to precisely locate the position of a stopped or slow moving vehicle in any of the sectors based on GPS navigation concepts. Moreover, it is envisioned that each module's information will be transmitted to all the other modules via an appropriate identification code. For instance, in the case of a stopped vehicle in a traveling lane, the modules could triangulate its position, and the modules 110 on the side of the road nearest the stopped lane could begin flashing a yellow signal (e.g. ½ mile) from vehicle, and red lights (e.g. ¼ mile) from the disabled vehicle. In turn, the modules 110 on that side of the road with the unobstructed lane/lanes could flash yellow (near an obstruction), directing the approaching traffic to merge to that side of the road. In the event that one or more of the modules malfunction (such as when neighboring modules fail to get a signal from their neighboring modules), the adjacent modules can (similar to GPS trajectories) still be able to identify stopped or slow moving vehicles. Malfunctioning units once detected can be reported autonomously to the network and to the ITS public safety coordination center for prompt repair or replacement.

Figure 2A:
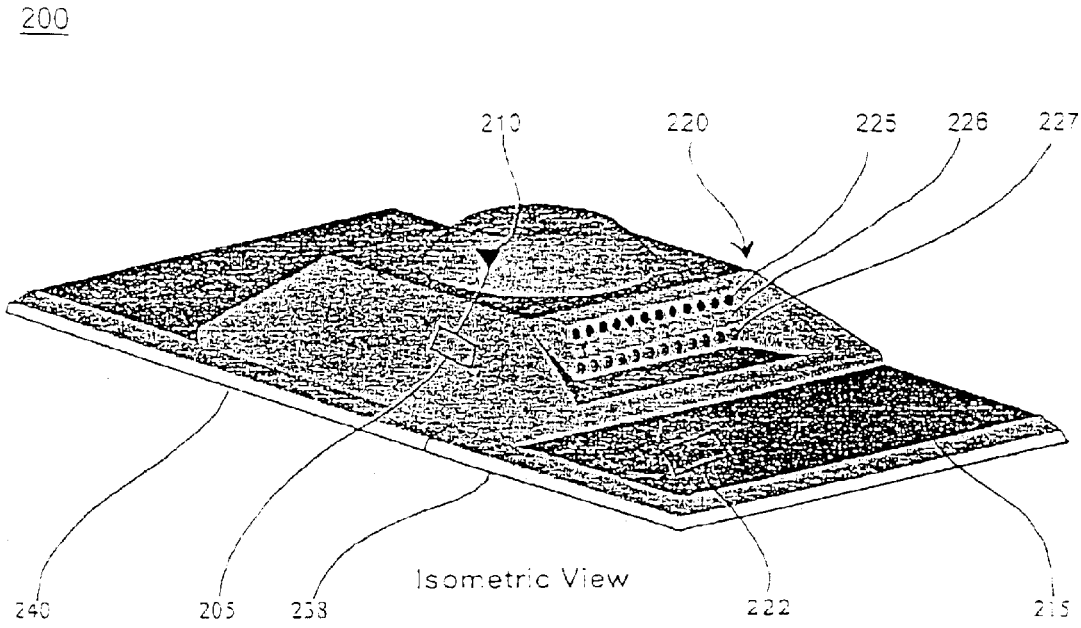
FIG. 2A shows an isometric view of an exemplary module, according to an embodiment of the invention.
Figure 2B:
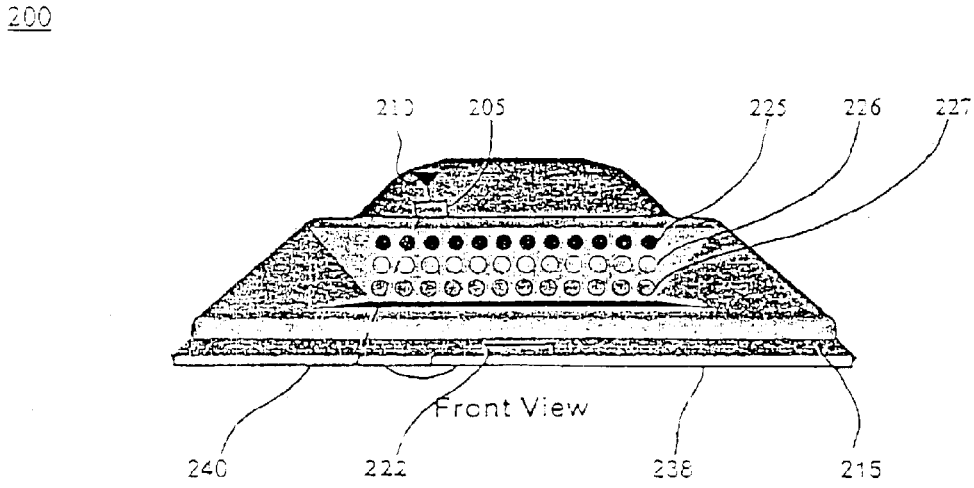
FIG. 2B shows a front view of the exemplary module shown in FIG. 2A.

FIG. 2A shows an isometric view of an exemplary UWB-based module 200, while FIG. 2B shows a front view of the same, according to an embodiment of the invention. Module 200 includes UWB transceiver/sensor 205 and UWB antenna 210. Antenna 210 preferably an omni-directional antenna. This will allow the modules to identify objects outside of the highway lanes. This is important to obtain a baseline background level from which dynamic events can be better identified.

The UWB transceiver/sensor 205 in each module may utilize either direct-sequence spread-spectrum, or pulse-hopping techniques. From an applications point of view, the system will work with either of these techniques, although one of them may be preferred from a hardware implementation point of view.

Modules also preferably include environmental sensor 238, a photovoltaic cell 215 along with rechargeable batteries 222 can be used to provide a self powered module. Alternatively, modules 200 can be powered by standard electrical service (not shown) to provide all or paxt of its power needs. Modules 200 also preferably include a computer or microcontroller, or other device which provides a CPU (240). The CPU can process information, such as information related to identifying stopped or slow moving traffic.

Each module provides an illuminated display 220, such as multiple high intensity lights, such as red 225, yellow 226 and green LEDs 227. The lights are preferably capable of continuous or multi-frequency flashing modes, and should be clearly visible to oncoming traffic. The high intensity lights can be used to automatically provide early warning to drivers of road conditions. In the event of normal road conditions ahead, green lights 227 can be used. In the event of an incident, such as an accident, the lights can provide early warning as to its severity by displaying either yellow 226 or red lights 225. Lights are preferably capable of both high and low intensity illumination for day or night operation, respectively.

Typically, green lights 227 will be on until an event causes another color (yellow 226 or red 225) to activate. Each module also preferably has a series of red and green lights on its opposite side (not shown), the opposite side being visible only to vehicles approaching the module from a direction opposite to the direction of normal traffic flow. Under normal conditions, the red lights on the opposite side will be on continuously, to indicate to a driver that their vehicle is on the wrong side of the road or lane if the driver happens to approach in the wrong direction. However, in certain situations, the opposite side lights can be green lights to aid traffic flow (e.g., to improve evacuation route coordination). Hence, modules 200 can vary their LED light colors in a multidirectional pattern.

In the event that an accident occurs, one or more modules near the accident can sense traffic stoppage and in real time automatically provide this information to modules ahead, such as several miles ahead, so that they can begin flashing red to provide early warning to drivers who are approaching the event. Similarly, the system can provide early warning to drivers about slowdowns in traffic, congestion, or weather conditions ahead, well before a driver would otherwise detect these conditions.

If an accident occurs, a module 200 or modules near the accident could sense (using its radar feature) traffic stoppage and immediately transmit, such as using UWB transceiver 205, this information to other modules 200 in the oncoming traffic direction of an impending slowdown or stoppage. These in turn could begin flashing yellow or red (depending on the distance from the accident) thereby warning oncoming drivers of the event. The super node (not shown in FIG. 2A or 2B) could also transmit this data to appropriate personnel relaying the exact location and extent of the accident.

Similarly, the system can warn drivers about slowdown in traffic, such as heavy traffic flow or congestion due to construction. The module 200 closest to the affected area can immediately notify the modules ahead (in the opposite lane) as well as those that are located preferably at least one to two miles in the lane of the affected area. These modules will then automatically begin flashing yellow or red, depending on the proximity to the event.

Modules can warn drivers of an approaching emergency vehicle, such as police, ambulance, or a fire truck. For instance, whenever the system is informed that an emergency vehicle is approaching (e.g., via a public safety coordination center), one entire lane can immediately begin flashing red (or some other color), so that normal traffic can clear the lane for the emergency transport vehicle(s).

Certain locations are known to impose added danger as compared to other roadway sections. For example, deaths are known to occur more frequently at railroad crossings. Locating modules 200 approaching these sites and other dangerous sites and providing constant warning signals can provide early warning to drivers well before arriving at these cites.

Transceiver 205 permits module 200 communications with remote locations other than other modules or supernodes. For example, transceivers 205 can communicate with an ITS central for sector information, such as accidents and slow downs and also communicate with vehicles equipped with UWB communication equipment.

The system can also be configured to be capable of being activated or controlled by authorized personnel in extreme events, such as evacuations and toxic spills. Thus, police can override the system and turn on the lights in display 200 if needed. For example, at a traffic checkpoint or temporary road construction area, police could turn on the lights to warn drivers about the affected area. Public safety officers can also turn on the warning LEDs to warn of an approaching emergency vehicle in a given travel lane. School buses can also activate the adjacent modules in both directions to warn drivers that stopped traffic operations were occurring or about to occur, such as children crossing the road. For example, when the flashing lights of the bus are activated an on-board module can transmit a triggering signal to prompt the respective modules to illuminate red lights.

In one embodiment of the invention, the modules can also communicate with the vehicles directly, such as by a wireless link (e.g. UWB) to transceivers within the vehicles themselves. With the advent of UWB radar now being incorporated in several luxury vehicles, such as Mercedes and Volvo, to control air-bag deployment and for collision avoidance, modules 200 can communicate with these vehicles. Hence, the driver can be provided road conditions at any point along the interstate system, noting accidents/congestion, alternate routes, roadway construction areas, even hundreds of miles away. For cars that are equipped with UWB transceivers, the system can transmit assistance information that can improve the accuracy of GPS-based navigation systems, as well as display on a map the location of accidents or other events that may affect the driver.

Modules 200 can also transmit ranging information for autonomous car cruise and steering control for cars equipped with UWB. For example, if a driver begins to fall asleep at the wheel, the radar unit can detect the unexpected large vehicle deviation and either warn the driver, or apply the brakes to slow the vehicle down. Signals could also be communicated from modules to sensors in cars connected to scat belts and air bags, such that when accident is determined by the system to be imminent, the seat belts are tightened and the inflation rate of the air bags can be adjusted.

In typical applications, modules are installed alongside the highway in the right-of-way, so accessibility would be improved over the reflectors now in service within the driving surface. However, the invention is not limited to applications along highway right of ways, or even on highways. For example, modules can be installed not only on the highway surface, but on light poles, on or beneath highway signs, on barriers, bridge piers, guard rails, medians and tunnels or other applicable locations. Modules can also be located along navigable waterways (canals, etc.) to help boaters navigate by monitoring the depth of water at their location.

Other Embodiments

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

We claim:

1. A vehicle safety and control system, comprising:

a network including a plurality of remotely located autonomous modules disposed alongside and spaced apart from a vehicle pathway, said modules each communicably connected to at least one other of said plurality of modules, said modules each including:

a measurement system comprising at least one sensor for autonomously obtaining sensor data, said sensor data including distance and velocity for objects proximate thereto, and an illuminated display having a plurality of observable distinct states, said observable states including states relating to said sensor data.

2. The system of claim 1, wherein each of said plurality of modules further comprise a wireless transceiver for transmitting and receiving data including said sensor data between said plurality of remotely located modules, wherein said remotely located modules are all wirelessly interconnected.

3. The system of claim 2, wherein said transceiver comprises an ultra wideband (UWB) radio unit, said UWB radio unit providing radar for obtaining said sensor data.

4. The system of claim 1, wherein said network is divided into a plurality of sectors, said sectors each including at least one centralized node, said centralized node wirelessly connected to respective ones of said plurality of modules in each of said sectors.

5. The system of claim 1, wherein said plurality of modules include at least one solar panel, wherein said system is powered at least in part by solar energy.

6. The system of claim 1, wherein said observable distinct states are provided by at least one LED, said LED capable of continuous or pulsed illumination.

7. The system of claim 1, wherein said system provides wireless communications between said plurality of modules and said vehicles.

8. The system of claim 7, wherein said modules wirelessly communicate with vehicles having a car navigation system.

9. The system of claim 8, wherein said car navigation system includes a UWB transceiver.

10. The system of claim 1, wherein said system automatically provides real-time remote roadway information to vehicles traveling along said vehicle pathway.

11. The system of claim 10, wherein said remote roadway information comprises at least one selected from the group consisting of traffic, accidents and weather.

12. The system of claim 1, wherein transmissions from each of said plurality of modules are distinguishable from one another.

13. The system of claim 1, wherein said sensor includes a visibility sensor for detecting at least one selected from the group consisting of fog, rain and smoke.

14. The system of claim 1, wherein said vehicle pathway comprises a motor vehicle roadway or a navigable waterway.

15. The system of claim 1, wherein said vehicle pathway includes at least a portion of an interstate highway system.

16. The system of claim 1, wherein said remotely located modules are affixed to fixed locations.

17. The system of claim 1, wherein said remotely located modules include a central processing unit (CPU).

18. The system of claim 1, wherein said remotely located modules are disposed in a staggered configuration along alternating sides of said vehicle pathway.

19. The system of claim 1, wherein said remotely located modules provide at least one of said plurality of observable distinct states to indicate approaching emergency vehicles.

20. A method for warning or directing vehicles, comprising the steps of: p1 disposing a network including a plurality of remotely located autonomous modules alongside and spaced apart from a vehicle pathway, said modules each comprising at least one sensor for autonomously sensing distance and velocity of objects proximate to said modules, said modules each communicably connected to at least one other of said plurality of modules, and generating visual warning or directing signals using a plurality of observable distinct lit states at said modules, said states relating to said sensor data.

21. The method of claim 20, wherein said plurality of modules include a wireless transceiver for transmitting and receiving data including sensor data.

22. The method of claim 21, wherein said transceiver comprises an ultra wideband (UWB) radio unit, said UWB radio unit providing radar for obtaining said sensor data.

23. The method of claim 20, wherein said observable distinct lit states are provided by at least one LED, said LED capable of continuous or pulsed illumination.

24. The method of claim 20, further comprising the step of communicating a wireless warning or control signal to vehicles traveling on said vehicle pathway.

25. The method of claim 24, wherein said vehicles include a car navigation system for supporting communications with said modules.

26. The method of claim 25, further comprising the step of automatically providing real-time remote roadway information to operators of automobiles via said car navigation system.

27. The method of claim 26, wherein said remote roadway information comprises at least one selected from the group consisting of traffic, accidents and weather.

28. The method of claim 20, wherein transmissions from each of said plurality of modules are distinguishable from one another.

29. The method of claim 20, wherein said vehicle pathway comprises a motor vehicle roadway or a navigable waterway.

30. The method of claim 20, wherein said vehicle pathway includes at least a portion of an interstate highway system.

31. The method of claim 20, wherein said remotely located modules provide at least one of said plurality of observable distinct states to indicate approaching emergency vehicles.

32. A method of sequencing traffic lights, comprising the steps of:

determining a vehicle traffic queue at or approaching a road intersection for each of a plurality of intersecting paths comprising said intersection using a plurality of remotely located autonomous modules having radar, said modules disposed alongside and spaced apart from said plurality of intersecting paths, said radar providing distance measurements for objects proximate thereto, each of said paths having an associated traffic signal, and setting respective times for said traffic signals based on said traffic queue.

33. The method of claim 32, wherein said radar is provided by an ultra wideband (UWB) radio unit.

* * * * *